US011708707B2

(12) United States Patent
Raatikainen

(10) Patent No.: US 11,708,707 B2
(45) Date of Patent: Jul. 25, 2023

(54) ELECTRONIC PADLOCK

(71) Applicant: Abloy Oy, Joensuu (FI)

(72) Inventor: Juha Raatikainen, Kontiolahti (FI)

(73) Assignee: ABLOY OY, Joensuu (FI)

( * ) Notice: Subject to any disclaimer, the term of this patent is extended or adjusted under 35 U.S.C. 154(b) by 0 days.

(21) Appl. No.: 18/014,278

(22) PCT Filed: Jun. 16, 2021

(86) PCT No.: PCT/FI2021/050452
§ 371 (c)(1),
(2) Date: Jan. 3, 2023

(87) PCT Pub. No.: WO2022/003236
PCT Pub. Date: Jan. 6, 2022

(65) Prior Publication Data

US 2023/0193658 A1 Jun. 22, 2023

(30) Foreign Application Priority Data

Jul. 1, 2020 (FI) ..... 20205701

(51) Int. Cl.
*E05B 47/00* (2006.01)
*E05B 67/22* (2006.01)
*E05B 15/04* (2006.01)

(52) U.S. Cl.
CPC ..... *E05B 47/0012* (2013.01); *E05B 15/04* (2013.01); *E05B 47/0002* (2013.01);
(Continued)

(58) Field of Classification Search
CPC .. E05B 47/0012; E05B 15/04; E05B 47/0002; E05B 67/22; E05B 2015/0406; E05B 2015/0437; E05B 2047/0024
See application file for complete search history.

(56) References Cited

U.S. PATENT DOCUMENTS 2,132,201 A * 10/1938 Allman ..... E05B 37/163 70/25
3,952,559 A * 4/1976 Atkinson ..... E05B 37/0034 70/25

(Continued)

FOREIGN PATENT DOCUMENTS

CN 206158371 U 5/2017
CN 107524357 A 12/2017

(Continued)

*Primary Examiner* — Mark A Williams

(74) *Attorney, Agent, or Firm* — Muncy, Geissler, Olds & Lowe, P.C.

(57) ABSTRACT

The electronic actuator of an electronic padlock according to the invention is arranged to turn the cam piece (5) to release the latch parts (7) from a locking state and to turn the cam piece (5) to hold the latch parts (7) in the locking state. The cam piece (5) comprises a cover part (5A) and a shaft part (5B). The cover part has a central hole (12) for the shaft part. The shaft part (5B) has a shaft pin (15), which is set into the central hole (12). The shaft part also has a connecting part 19, which is arranged to be in contact with the electronic actuator 4. The cam piece further comprises a spring (9) which is between the shaft pin (15) and the cover part (5A). The spring comprises a first end (9A) and a second end (9B). The first end 9A is arranged to be in contact with the cover part 5A. The second end 9B is arranged to be in contact with the shaft part 5B. The spring is arranged to transmit turning force of the electronic actuator from the shaft pin 15 to the cover part 5A in the direction of said locking state.

8 Claims, 3 Drawing Sheets

Figure 1:
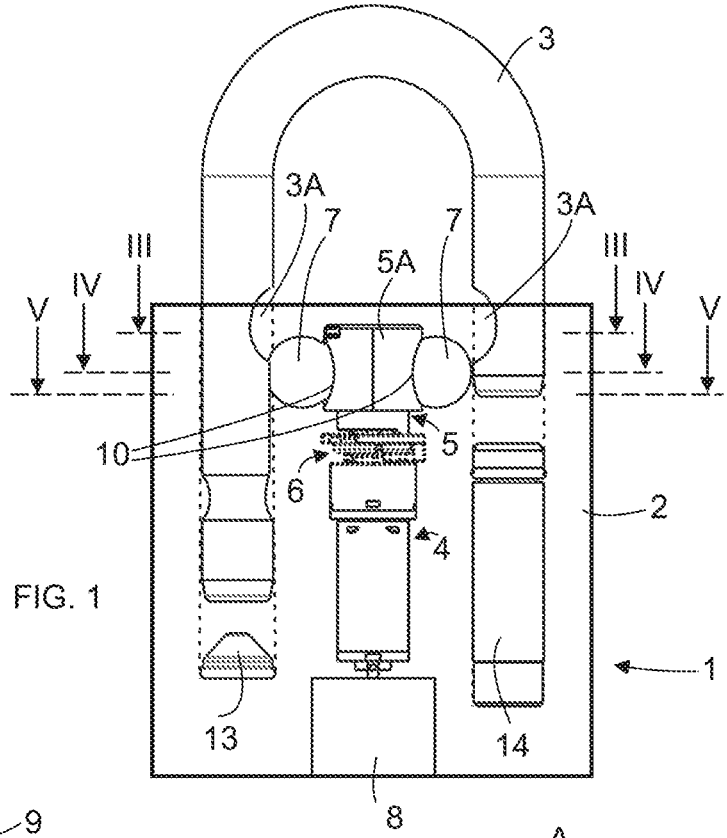

(52) U.S. Cl.
CPC ..... *E05B 67/22* (2013.01); *E05B 2015/0406* (2013.01); *E05B 2015/0437* (2013.01); *E05B 2047/0017* (2013.01); *E05B 2047/0024* (2013.01)

(56) References Cited

U.S. PATENT DOCUMENTS

| | | | | |
|---|---|---|---|---|
| 4,763,496 | A * | 8/1988 | Evans | E05B 67/24 70/52 |
| 4,938,039 | A * | 7/1990 | Tzung-I | E05B 67/24 70/38 C |
| 6,442,983 | B1 * | 9/2002 | Thomas | E05B 47/0012 70/278.1 |
| 6,761,051 | B1 * | 7/2004 | Tsai | E05B 47/0012 70/279.1 |
| 9,109,379 | B1 * | 8/2015 | Ranchod | E05B 67/00 |
| 2006/0288744 | A1 * | 12/2006 | Smith | G07C 9/33 70/38 B |
| 2009/0282876 | A1 * | 11/2009 | Zuraski | E05B 67/003 70/278.1 |
| 2012/0011902 | A1 * | 1/2012 | Meekma | E05B 47/0012 70/52 |
| 2013/0086956 | A1 * | 4/2013 | Nave | E05B 47/0012 70/20 |
| 2013/0118216 | A1 * | 5/2013 | Kalous | G07C 9/00944 70/20 |
| 2013/0276487 | A1 * | 10/2013 | Burmesch | E05B 67/24 29/434 |
| 2014/0157838 | A1 * | 6/2014 | Nave | E05B 67/22 70/52 |
| 2016/0049032 | A1 * | 2/2016 | Ranchod | E05B 47/00 70/20 |
| 2016/0312497 | A1 * | 10/2016 | McGinnis | E05B 67/06 |
| 2017/0169637 | A1 * | 6/2017 | Lai | E05B 47/0004 |
| 2017/0268260 | A1 * | 9/2017 | McGinnis | E05B 63/0056 |
| 2018/0112437 | A1 * | 4/2018 | Chow | G07C 9/00174 |
| 2018/0165901 | A1 * | 6/2018 | Lai | E05B 67/24 |
| 2020/0248483 | A1 * | 8/2020 | Melkovitz | E05B 29/00 |
| 2021/0156172 | A1 * | 5/2021 | Liu | G07C 9/00674 |

FOREIGN PATENT DOCUMENTS

| | | | |
|---|---|---|---|
| CN | 110107165 | A | 8/2019 |
| CN | 110439377 | A | 11/2019 |
| WO | WO2015049680 | A1 | 4/2015 |
| WO | WO2018184070 | A1 | 10/2018 |
| WO | WO2019200554 | A1 | 10/2019 |
| WO | WO2019223522 | A1 | 11/2019 |

* cited by examiner

ELECTRONIC PADLOCK

FIELD OF THE INVENTION

The invention relates to electronic padlocks. The invention particularly relates to electronic padlocks, in which an electronic actuator is arranged to turn a cam piece in order to release latch parts from a locking state. When the latch parts are released from the locking state, the electronic padlock can be opened.

PRIOR ART

Prior art electronic padlocks often use an electronic actuator for opening the locking. The electronic padlock can receive an opening code in different ways, depending on the implementation method. The opening code can be entered in the electronic padlock for example from a mobile phone via a Bluetooth connection or via some other wireless network. RFID technology or NFC technology can also be used. The electronic padlock can also have a keyboard or a touch screen for entering the opening code, or the lock has for example a fingerprint identifier. When the correct opening code has been entered into the electronic padlock, the electronic actuator in the lock releases the locking, whereby the padlock can be opened. When the locking is released, the padlock shackle can be moved from the closed position to the open position, i.e. the padlock can be opened.

The electronic actuator can for example be an electric motor, which is arranged to turn the cam piece of the padlock. The cam piece is a part, which holds the latch parts against counter holes in the shackle, when the padlock is locked. When the electronic padlock receives the correct opening code, the electronic actuator turns the cam piece (usually 90 degrees), so that the recesses in the cam piece are by the latch parts. Thus, the latch parts can move away from the counter hole in the shackle, i.e. the locking state is released, and the electronic padlock can be opened. When the electronic padlock is locked, the shackle is in the closed position and the electronic actuator turns the cam piece into the locking position, whereby it holds the latch parts against the counter holes in the shackle. The latch parts are normally balls.

Known electronic padlock solutions, which have an electronic actuator, are presented in publications WO 2018184070, US 2013276487, CN 206158371 and WO 2019223522.

In electronic padlocks like the ones described above, the electronic actuator can break, when it turns the cam piece to lock the electronic padlock. If a jerk is simultaneous directed at the shackle, which jerk strives to move the shackle to the open position, the latch parts start to move back into the recesses in the cam piece, which in turn causes the cam piece to turn against the turning force of the electronic actuator. The turning of the cam piece against the turning direction of the electronic actuator can break the electronic actuator.

BRIEF DESCRIPTION OF THE INVENTION

The object of the invention is to provide an electronic padlock, which eliminates or at least significantly reduces the possibility of breaking of the electronic actuator of the electronic padlock, when the electronic padlock is being locked. This is achieved in the manner presented in the independent claim. The dependent claims present different embodiments of the invention.

The electronic padlock according to the invention comprises a body 2 and a shackle 3. The body has latch parts 7, a cam piece 5 and an electronic actuator 4. The electronic actuator is arranged to turn the cam piece 5 to release the latch parts 7 from a locking state, and to turn the cam piece 5 to hold the latch parts 7 in the locking state. In the locking state, the latch parts 7 prevent the shackle 3 from being moved to open the electronic padlock. The cam piece 5 comprises a cover part 5A and a shaft part 5B. The cover part has a central hole 12 for the shaft part and recesses 10 on the surface of the cover part. The shaft part 5B has a shaft pin 15, which is set into the central hole 12. The shaft part also has a connecting part 19, which is arranged to be in contact with the electronic actuator 4. The cam piece further comprises a spring 9, which is between the shaft pin 15 and the cover part 5A. The spring comprises a first end 9A and a second end 9B. The first end 9A is arranged to be in contact with the cover part 5A. The second end 9B is arranged to be in contact with the shaft part 5B. The spring is arranged to transmit turning force of the electronic actuator from the shaft pin 15 to the cover part 5A in the direction of said locking state.

The shaft part further comprises at least one protrusion 17 on the surface of the shaft pin 15 and/or on the surface of the connecting part 19. This protrusion is arranged to transmit turning force of the electronic actuator from the shaft pin 15 to the cover part 5A to release the latch parts. The spring is further arranged to allow turning of the cover part 5A against the turning force of the electronic actuator from the shaft pin 15 to the cover part 5A.

LIST OF FIGURES

Figure 2:
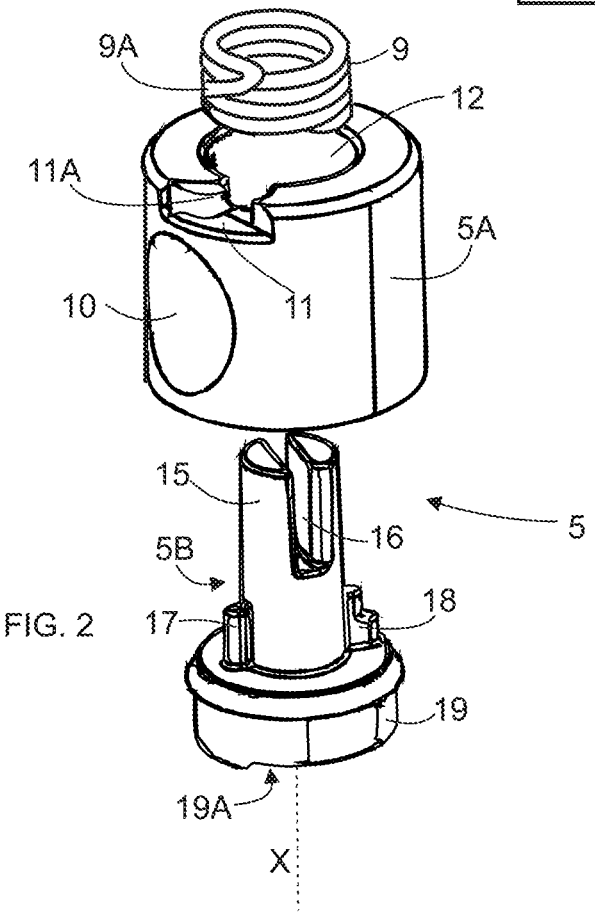
Figure 3:
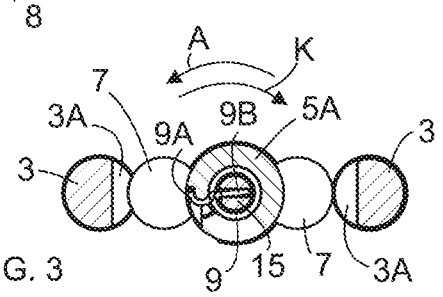
Figure 4:
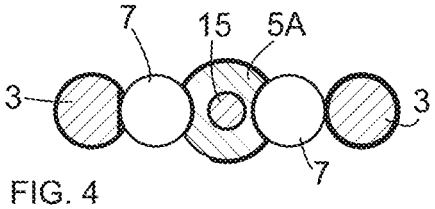
Figure 5:
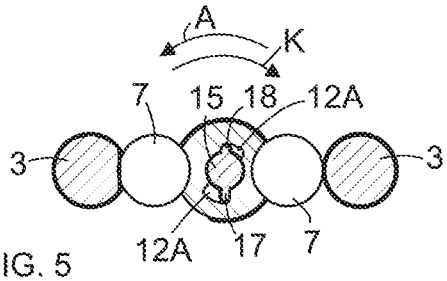
Figure 6:
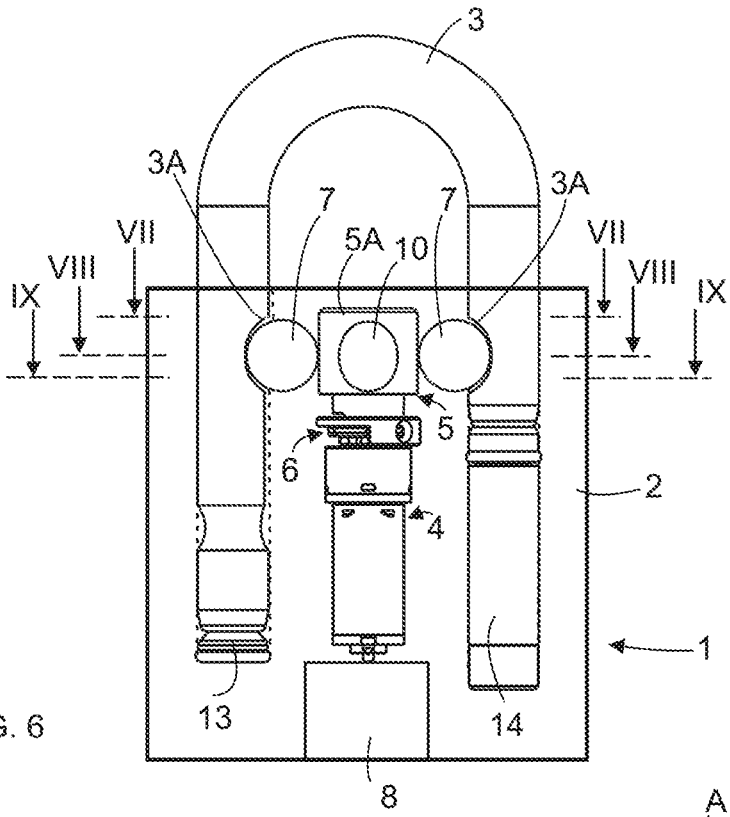
Figure 7:
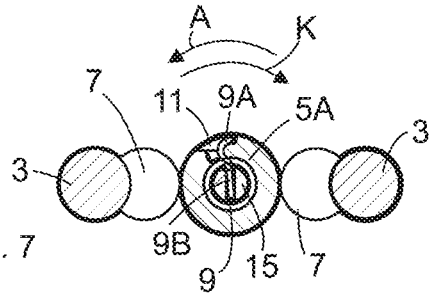
Figure 8:
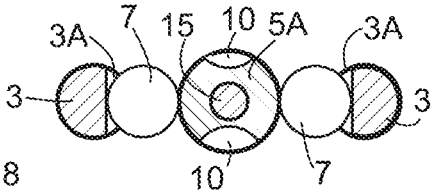
Figure 9:
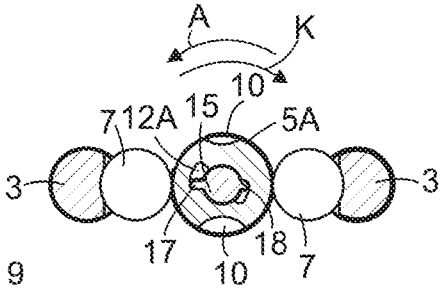
Figure 10:
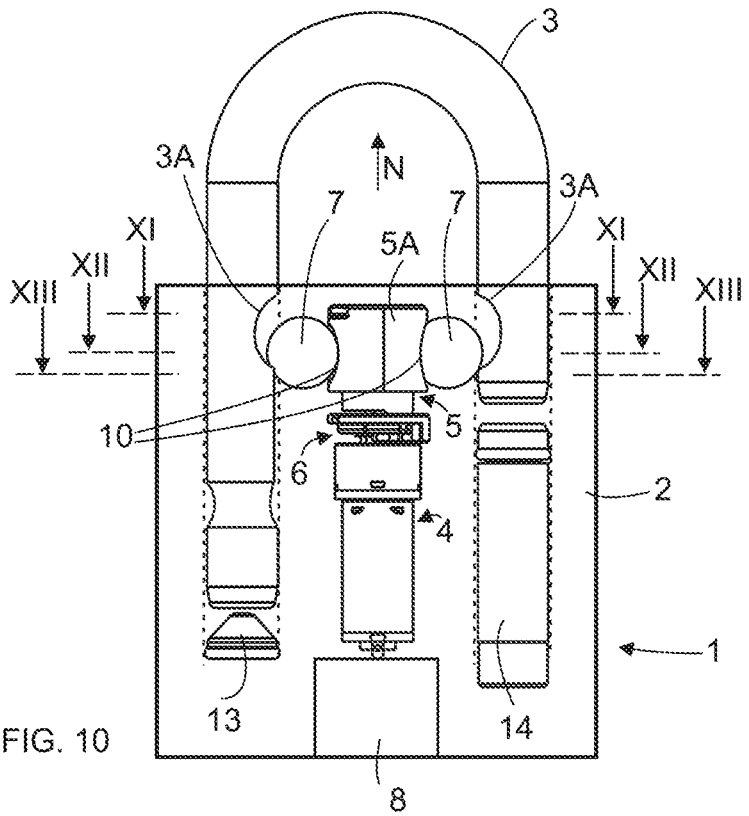
Figure 14:
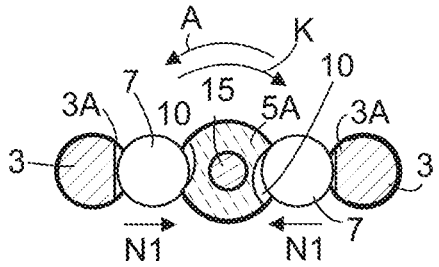
Figure 11:
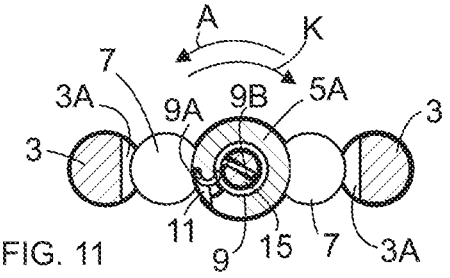
Figure 12:
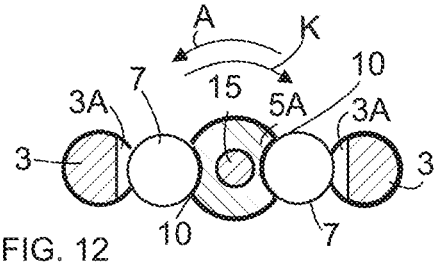
Figure 13:
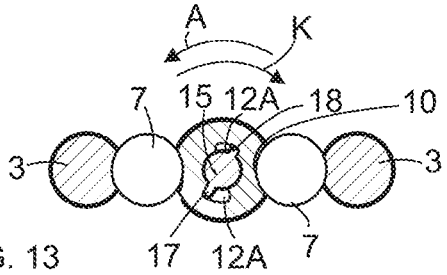

In the following, the invention will be described in more detail with reference to the appended figures, in which FIG. 1 shows an example of an electronic padlock according to the invention as opened, FIG. 2 shows an example of the cam piece of an electronic padlock according to the invention, FIG. 3 shows a section of the example of FIG. 1, FIG. 4 shows a second section of the example of FIG. 1, FIG. 5 shows a third section of the example of FIG. 1, FIG. 6 shows an example of an electronic padlock according to the invention as locked, FIG. 7 shows a section of the example of FIG. 6, FIG. 8 shows a second section of the example of FIG. 6, FIG. 9 shows a third section of the example of FIG. 6, FIG. 10 shows an example of an electronic padlock according to the invention, when an outward pulling jerk has been directed at the shackle when locking the electronic padlock, FIG. 11 shows a section of the example of FIG. 10, FIG. 12 shows a second section of the example of FIG. 10, FIG. 13 shows a third section of the example of FIG. 10, and FIG. 14 shows an illustrative example of the electronic padlock according to the invention at the beginning of a jerk directed at the shackle.

DESCRIPTION OF THE INVENTION

FIG. 1 shows an example of an electronic padlock 1 according to the invention. FIG. 1 shows a situation, where the electronic padlock is opened and the shackle can be raised even higher than FIG. 1 shows.

The electronic padlock according to the invention comprises a body 2 and a shackle 3. The body has latch parts 7, a cam piece 5 and an electronic actuator 4. The electronic actuator is arranged to turn the cam piece 5 to release the latch parts 7 from a locking state, and to turn the cam piece 5 to hold the latch parts 7 in the locking state. In the locking state, the latch parts 7 prevent the shackle 3 from being moved to open the electronic padlock. The locking state is shown in FIG. 6. The shackle 3 has holes 3A for the latch parts. In the locking state, the latch parts 7 are partly in the shackle holes 3A, whereby they prevent the shackle from being pulled out in relation to the body 2. The electronic padlock is thus locked.

The body 2 of the electronic padlock 1 has spaces (such as drillings) for different parts of the padlock. These spaces are not shown in more detail in FIG. 1, for the sake of clarity. The electronic padlock also comprises other parts than the ones mentioned above, such as indicators 13, 14, to indicate if the shackle is completely inside the body, whereby the electronic padlock can be locked with the electronic actuator 4. The electronic actuator and cam piece are put into the body in the space/drilling reserved for them, and held inside the lock body with a lid part 8. The lid part is for example a cylinder equipped with an outer thread, which is locked to the body with a separate locking screw (not shown in the figures). The figures do not show all parts of the electronic padlock. The figures show the parts, which are necessary for describing the invention.

The electronic actuator 4 can be directly connected to the cam piece 6, so that the electronic actuator can turn the cam piece. The electronic actuator turns the cam piece to open the locking of the electronic padlock or to lock the electronic padlock. The electronic padlock can also comprise a separate power transmission part 6 between the electronic actuator 4 and the shaft part 5B. Thus, the power transmission part 6 transmits the force turning the electronic actuator to the cam piece 5. The power transmission part can also comprise other functions. It can for example also functions as a blocking mechanism. The blocking mechanism allows turning of the cam piece with the electronic actuator, but strives to prevent any other turning of the cam piece 5 in relation to the body 2.

An embodiment of the cam piece 5 according to the invention is shown in FIG. 2. The cam piece 5 comprises a cover part 5A and a shaft part 5B. The cover part has a central hole 12 for the shaft part and recesses 10 on the surface of the cover part. The shaft part 5B has an axle pin 15, which is set into the central hole 12. The shaft part also has a connecting part 19, which is arranged to be in contact with the electronic actuator 4. The diameter of the connecting part 19 can be wider than the diameter of the shaft pin, as illustrated in FIG. 2. The diameters of both the connecting part 19 and the shaft pin 15 are perpendicular in relation to the longitudinal axis X of the shaft pin. The cam piece further comprises a spring 9, which is between the shaft pin 15 and the cover part 5A. The spring is thus also placed in the central hole 12. In the figures the spring is a coil spring, which is shaped as a torsion spring, but it can also be another type of spring.

The spring comprises a first end 9A and a second end 9B. The first end 9A is arranged to be in contact with the cover part 5A. The second end 9B is arranged to be in contact with the shaft part 5B. The spring is arranged to transmit turning force of the electronic actuator from the axle pin 15 to the cover part 5A in the direction of said locking state. In other words, the spring is arranged to transmit the turning force of the electronic actuator, which turns the shaft pin, via the first end 9A of the spring to the cover part 5A to turn it into the locking position.

The shaft part further comprises at least one protrusion 17 on the surface of the shaft pin 15 and/or on the surface of the connecting part 19. This protrusion is arranged to transmit turning force of the electronic actuator from the shaft pin 15 to the cover part 5A to release the latch parts. In other words, when the locking of the electronic padlock is opened, the electronic actuator 4 turns (either directly or via a power transmission part 6) the connecting part 19, the protrusion/protrusions 17, 18 of which transmit the turning force to the cover part 5A. The force used for opening the electronic padlock is thus transmitted via at least one protrusion 17, 18 and the force used for locking via the spring 9. In the embodiment of FIG. 2, two protrusions are placed at the base of the shaft pin 15 against the connecting part 19.

The spring is further arranged to allow turning of the cover part 5A against the turning force of the electronic actuator from the shaft pin 15 to the cover part 5A. Such a situation can happen, if simultaneously a jerk is directed at the shackle, which jerk strives to move the shackle to the open position. In the open position, the shackle can be set in the target, so that the target can be locked, when the electronic padlock is locked.

FIGS. 3-5 show sectional depictions of the embodiment of FIG. 1. From FIG. 3 can be seen how the second end of the spring 9 is arranged against the shaft pin. The shaft pin 15 can comprise a groove 16 or a hole for the second end 9B of the spring. The groove 16 can split the shaft pin on the side of its free end a part of the way toward the connecting part 19, as shown in FIG. 2. This way, installation of the spring is easy. In the embodiment of the figures, the second end 9B of the spring is in the direction of the diameter of the shaft pin, but it can also be for example in the direction of the longitudinal axis X of the shaft pin, whereby the shaft pin has a hole (such as a drilling) for the second end of the spring. The cover part 5A in turn comprises a hole 11 for the first end 9A of the spring. The hole has a side surface 11A for transmitting turning force between the end 9A of the spring and the cover part 5A.

FIG. 4 shows how the latch parts 7 are in the recesses 10 in the cover part 5A, when the electronic padlock is open. FIGS. 3 and 5 show the turning direction A, by turning in which direction the shaft pin 15 transmits the turning force of the electronic actuator via the protrusions 17, 18 to the cover part 5A. In other words, the electronic padlock is opened with the electronic actuator by turning the shaft part 5B and thus also the cover part 5A in the opening turning direction A. The spring 9 does thus not transmit turning force. FIGS. 3 and 5 also show a second turning direction K, by turning in which direction the electronic padlock is locked.

FIG. 6 shows the electronic padlock as locked. FIGS. 7-8 show sectional depictions of the embodiment of FIG. 6. FIGS. 6 and 8 show how the latch parts 7 are partly in the holes 3A of the shackle and the recesses 10 in the cover part are not toward the latch parts. Thus, the cover part 5A holds the latch parts against the holes 3A in the shackle, and the electronic padlock is in the locking state. FIGS. 7 and 9 show the turning direction K toward the locking of the electronic padlock. As can be seen, the spring 9 has (via the ends 9A, 9B of the spring) transmitted the turning force from the shaft pin 15 to the cover part 5A. As was already noted before, the turning force has been transmitted from the electronic actuator 4 to the shaft pin 15. The protrusion 17, 18 or protrusions of the shaft part 5B do not transmit turning force in the locking direction K, as can be seen in FIG. 9. The central hole 12 comprises at least one recess 12A for said at least one protrusion 17. The recess/recesses 12A is/are wider than the protrusion/protrusions 17, 18. FIGS. 7 and 9 also show the opening turning direction A for opening the electronic padlock.

FIGS. 10-14 show a situation, where the electronic padlock is locked with the electronic actuator 4 by turning the shaft part (and its shaft pin 15) in the turning direction K, whereby also the cover part 5A turns via the spring 9. Simultaneously, a jerk has been directed at the shackle in the direction N, which jerk strives to move the shackle to the open position. Thus, the latch parts 7 strive to move back toward the recesses 10 in the cover part 5A, which in turn turns the cover part in the opposite direction (i.e. the opening direction A) to the direction in which the electronic actuator turns the cover part. A large stress is thus directed at the electronic actuator, which may break it.

The spring 9, however, allows the cover part to turn in such a situation in the opening direction A, even though the shaft pin turns as turned by the electronic actuator in the locking direction K. Thus, only a part of the force of the jerk is directed at the electronic actuator, because a part of the force goes into tensing the spring 9. FIGS. 11-13 show this situation, where the spring 9 is tensed due to a jerk or other external force and the cover part 5A has turned in the turning direction A against the turning direction K of the electronic actuator.

FIG. 14 illustrates how the movement of the shackle caused by the jerk moves N1 the latch parts 7 toward the cover part 5A. Via the recesses 10, the force of the jerk turns the cover part in the turning direction A. FIG. 14 shows the starting phase of the jerk. FIGS. 11-13 show how the spring 9 has received the external force (jerk) and allowed the cover part 5A to turn in the turning direction A. The recesses 12A of the central hole 12 are designed to allow this turning due to an external force, as FIG. 13 illustrates. It is desirable that the width of the recess 12A of the central hole is not wider than the width necessary for the turning of the cover part in the turning direction A against the turning of the electronic actuator in the turning direction K. On the other hand, the recess/recesses 12A of the central hole can also be wider.

The electronic padlock according to the invention can be implemented in many different ways. For example, there can be various embodiments of the parts of the cam piece 5. As FIG. 2 illustrates, the connecting part 19 comprises a transmission surface 19A, via which the shaft part 5B is arranged to be in contact with the electronic actuator 4. The transmission surface 19A comprises at least one recess and/or protrusion. The shapes of the transmission surface can thus have different embodiments.

The latch parts 7 are balls or pins, the ends of which pins are hemispherical. The electronic actuator 4 can be an electric motor or a solenoid. Using an electric motor is usually more straight-forward, but turning the cam piece can be done also with a solenoid. Thus, the electronic actuator 4 has some kind of power transmission to transmit the movement of the solenoid (such as the movement of the pin of the solenoid) into a turning movement. The opening and locking of the electronic padlock (entering the opening code, lock ready to be locked, locking command) is implemented in an otherwise known manner, so it is not described in further detail in this context.

The solution according to the invention effectively prevents breaking of the electronic actuator of the electronic padlock, such as the electric motor, if an external force, which pulls the shackle away from the body of the electronic padlock, is directed at the shackle at the closing phase.

The electronic padlock according to the invention can be realized in many different ways, as can be discerned from the description above. The invention is thus not limited to the examples presented herein, but can be implemented in different ways within the scope of the independent claim.

The invention claimed is:

1. An electronic padlock, which comprises a body and a shackle, in which the body has latch parts, a cam piece, and an electronic actuator, in which the electronic actuator is arranged to turn the cam piece to release the latch parts from a locking state and to turn the cam piece to hold the latch parts in the locking state, in which, when in the locking state, the latch parts prevent the moving of the shackle to open the electronic padlock, wherein the cam piece comprises a cover part and a shaft part, in which the cover part has a central hole for the shaft part and recesses on the surface of the cover part, and in which the shaft part has a shaft pin, which is set in the central hole, and a connecting part, which is arranged to be in contact with the electronic actuator, in which the cam piece additionally comprises a spring installed between the shaft pin and the cover part, in which the spring comprises a first end and a second end, in which the first end is arranged to be in contact with the cover part and in which the second end is arranged to be in contact with the shaft part, in which the spring is arranged to transmit a turning force of the electronic actuator from the shaft pin to the cover part in the direction of said locking state, and in which the shaft part further comprises at least one protrusion on the surface of the shaft pin and/or on the surface of the connecting part, in which the protrusion is arranged to transmit turning force of the electronic actuator from the shaft pin to the cover part to release the latch parts, and in which the spring is further arranged to allow turning of the cover part against the turning force of the electronic actuator if the spring is tensioned due to an external force, and the central hole comprises at least one recess for said at least one protrusion, in which the recess is wider than the protrusion, and the cover part comprises a hole for the first end of the spring, in which the hole has a side surface for transmitting the turning force between the end of the spring and the cover part.

2. The electronic padlock according to claim 1, wherein the shaft pin comprises a groove or hole for the second end of the spring.

3. The electronic padlock according to claim 2, wherein the connecting part comprises a transmission surface, via which the shaft part is arranged to be in contact with the electronic actuator.

4. The electronic padlock according to claim 3, wherein the transmission surface comprises at least one recess and/or protrusion.

5. The electronic padlock according to claim 4, wherein the diameter of the connecting part is wider than the diameter of the shaft pin, while both diameters are perpendicular to the longitudinal axis of the shaft pin.

6. The electronic padlock according to claim 5, wherein the electronic padlock comprises a separate power transmission part between the electronic actuator and the connecting part.

7. The electronic padlock according to claim 6, wherein the latch parts are balls or pins, the ends of which pins are hemispherical.

8. The electronic padlock according to claim 7, wherein the electronic actuator is an electric motor or a solenoid.

* * * * *